US007476142B2

(12) United States Patent
Mastrosimone-Gese

(10) Patent No.: US 7,476,142 B2
(45) Date of Patent: Jan. 13, 2009

(54) INTERACTIVE ENTERTAINMENT APPARATUS

(75) Inventor: Mary G. Mastrosimone-Gese, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 259 days.

(21) Appl. No.: 11/069,036

(22) Filed: Mar. 2, 2005

(65) Prior Publication Data

US 2006/0199468 A1 Sep. 7, 2006

(51) Int. Cl.
*A63H 33/00* (2006.01)
*A63H 23/08* (2006.01)

(52) U.S. Cl. ..... 446/227; 446/267

(58) Field of Classification Search ..... 446/227–228, 446/236, 267

See application file for complete search history.

(56) References Cited

U.S. PATENT DOCUMENTS

| | | | | | |
|---|---|---|---|---|---|
| 1,449,772 | A | * | 3/1923 | Miller | 362/101 |
| D175,089 | S | | 7/1955 | Newmark | |
| 3,898,781 | A | | 8/1975 | Facchini | |
| 4,223,471 | A | * | 9/1980 | Greenberg | 446/198 |
| 4,362,299 | A | * | 12/1982 | Suzuki | 273/457 |
| 4,834,688 | A | | 5/1989 | Jones | |
| 5,047,267 | A | | 9/1991 | Pantaleo et al. | |
| 5,104,699 | A | * | 4/1992 | Pantaleo et al. | 428/13 |
| 5,195,918 | A | * | 3/1993 | Mozes | 446/227 |
| 5,256,457 | A | | 10/1993 | Pantaleo et al. | |
| 5,256,459 | A | * | 10/1993 | Carlson | 428/36.3 |
| 5,516,322 | A | | 5/1996 | Myers | |
| 5,540,720 | A | * | 7/1996 | Ortega | 606/235 |
| 5,656,341 | A | * | 8/1997 | Pantaleo | 428/13 |
| 5,709,582 | A | * | 1/1998 | O'Donnell | 446/227 |
| 6,109,998 | A | | 8/2000 | DiResta et al. | |
| 6,113,455 | A | | 9/2000 | Whelan et al. | |
| 6,139,395 | A | | 10/2000 | Liao | |
| 6,145,227 | A | | 11/2000 | Liao | |
| 6,386,941 | B1 | * | 5/2002 | Lin | 446/267 |
| 6,413,141 | B1 | * | 7/2002 | Putney | 446/227 |
| 6,484,425 | B1 | | 11/2002 | Hirsch | |
| 6,533,637 | B1 | | 3/2003 | Liao | |
| 6,699,092 | B1 | * | 3/2004 | Cimerman et al. | 446/153 |
| 2003/0064818 | A1 | * | 4/2003 | Drosendahl et al. | 472/118 |

(Continued)

OTHER PUBLICATIONS

Fisher-Price Lights 'n Sounds Aquarium, Product No. 71264 (Feb. 1999).

(Continued)

*Primary Examiner*—Eugene Kim
*Assistant Examiner*—Alyssa M Hylinski
(74) *Attorney, Agent, or Firm*—Edell, Shapiro & Finnan, LLC

(57) ABSTRACT

An interactive entertainment apparatus comprising a structure for use with a child receiving device is disclosed. The entertainment apparatus includes a fluid-filled, pliable container portion capable of being selectively compressed by a user to displace the fluid within the container. The apparatus includes attachment mechanism configured to secure the apparatus to a child receiving device proximate a child received in the child receiving device such that the child can contact the pliable transparent portion of the base to displace the fluid. The apparatus may further include an infant mobile including a support arm, a housing suspended by the support arm, and one or more hanging elements suspended from the housing.

28 Claims, 12 Drawing Sheets

U.S. PATENT DOCUMENTS

| | | | | |
|---|---|---|---|---|
| 2003/0201662 | A1* | 10/2003 | Armbruster et al. | 297/295 |
| 2005/0026536 | A1* | 2/2005 | Armbruster et al. | 446/227 |

OTHER PUBLICATIONS

Fisher-Price Salary Night Mobile Product Guide (Product No. 73458, © 2001).

Infantino, Aqua Fun Water-Filled Playmat, http://www.infantino.com/Toys/Activity/06Months/AquafunPlaymat.html, Mar. 24, 2004.

Fisher-Price Nature Bearries™ Butterfly Dreams™ Mobile w/remote control, http://www.fisher-price.com/us/products/product.asp?id=28558, Mar. 26, 2004.

1-2-3 Discovery Lane®, The 3-Stage Crawling Toy, http://www.tinylove.com/pages/catalog.asp?PageID=63&prodID=35, Mar. 24, 2004.

Symphony-in-Motion™ Mobile with Remote Control, http://tinylove.com/pages/catalog.asp?PageID=278&prodID=86, Mar. 26, 2004.

Infantino Duck Water-Filled Playmat, http://www.infantino.com/Toys/Activity/06Months/DuckPlaymat.html, Mar. 24, 2004.

MisterArt Creativity For Kids Wiggly Water Tube Kit, http://www.misterart.com/store/view/005/group_id/8493/CREATIVITY-FOR-KIDS-Wiggly-Water-Tube-Kit.htm, Mar. 24, 2004.

* cited by examiner

INTERACTIVE ENTERTAINMENT APPARATUS

FIELD OF THE INVENTION

The present invention relates to an interactive entertainment apparatus and, more particularly, to an entertainment apparatus for use with a child-receiving device and including a fluid housed therein.

BACKGROUND

Infants develop by interacting with their surrounding environment. Sensory stimuli are an infant's first sources of learning (infants learn through audio and visual stimulation related to different fields of experience). For example, seeing bright colors, bold patterns, and moving elements fosters development of visual tracking skills. Listening to music and sounds stimulates auditory skills, while touching materials of varying texture enhances tactile skills. Each of these activities, moreover, encourages an infant to use and develop its cognitive skills to differentiate among various sights, sounds, and textures. Consequently, toys are often developed to create an interactive, sensory stimulating experience for an infant. For example, crib toys such as light projectors and mobiles aid the development of an infant by improving vision and eye-tracking skills. When an infant focuses on either an object suspended from a mobile or on an image projected onto a wall or ceiling, visual tracking skills are stimulated. In addition, music and sounds generated by the toys can not only enhance listening skills, but also inspire creative thinking. While current crib-mounted toys provide some sensory stimulation, it is desirable to increase the potential skill development of an infant by increasing the level of interaction an infant may have with the toys. In particular, it is desirable to provide a highly interactive experience for the infant via an entertainment device such as a crib-mounted toy or mobile.

This invention is directed generally to an interactive entertainment apparatus for use with a child-receiving device such as a crib. The interactive entertainment apparatus may comprise a fluid-filled housing with a transparent portion enabling an infant to view the fluid. The interactive entertainment apparatus may further comprise a fluid-filled container including a pliable portion adapted such that an infant may contact the pliable portion and move the fluid within the container. Providing such visual or tactile interaction increases the development potential of an infant by providing an additional level of sensory stimulation.

SUMMARY

The present invention is directed toward an interactive entertainment apparatus comprising a structure configured to mount on a child-receiving device such as a crib. In one embodiment, the apparatus includes a fluid-filled, pliable portion capable of being selectively compressed by a user to displace the fluid within the container. In another embodiment, the apparatus may further include a base with a transparent, fluid filled portion, an infant mobile including a support arm, a housing suspended by the support arm, and one or more hanging elements suspended from the housing.

DETAILED DESCRIPTION

Figure 1:
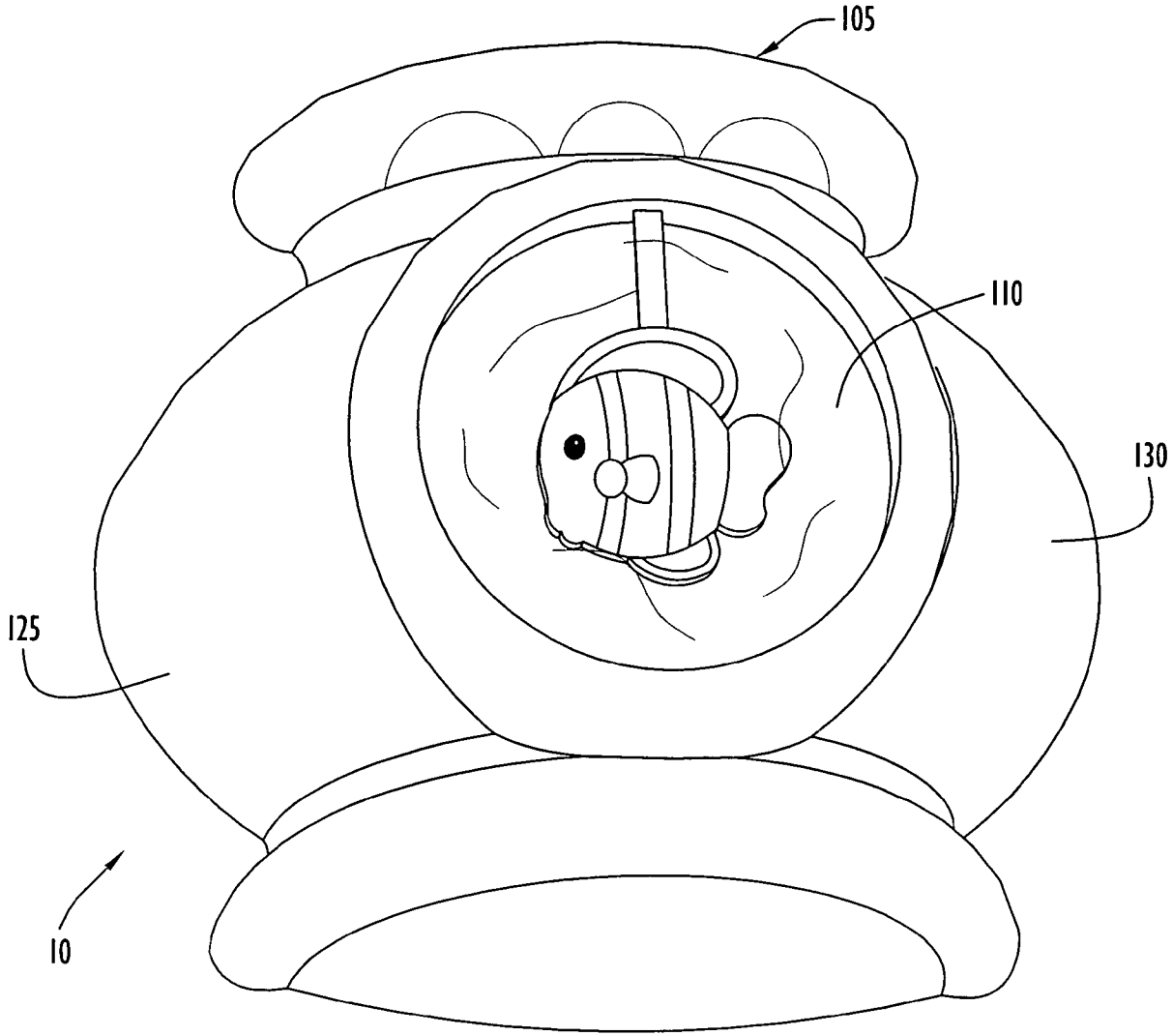
FIG. 1 illustrates a front perspective view of an interactive entertainment apparatus according to an embodiment of the present invention.
Figure 2:
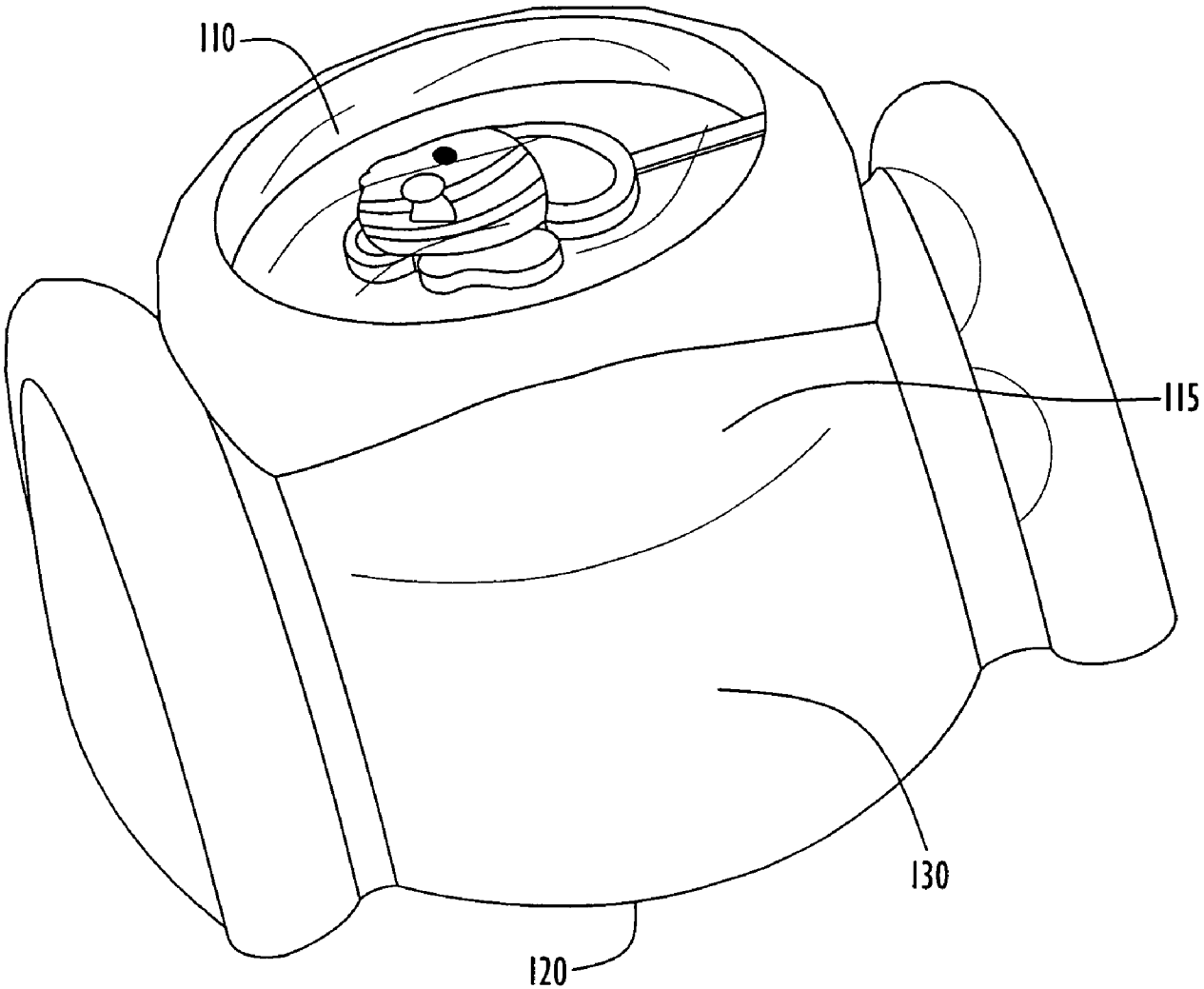
FIG. 2 illustrates a side perspective view of the interactive entertainment apparatus of FIG. 1.

In accordance with the present invention, an interactive entertainment apparatus is disclosed. FIGS. 1 and 2 illustrate an interactive entertainment apparatus 10 according to an embodiment of the invention. As shown, the interactive entertainment apparatus 10 includes a shell 105 with a fluid-filled container 110. The shell 105 may include a generally hollow structure configured to house entertainment and/or electronic components of the interactive entertainment apparatus 10. As shown in FIGS. 1 and 2 and by way of example, the shell 105 may include a front wall or surface 115, a rear wall or surface 120, a left wall or surface 125, and a right wall or surface 130.

Figure 3:
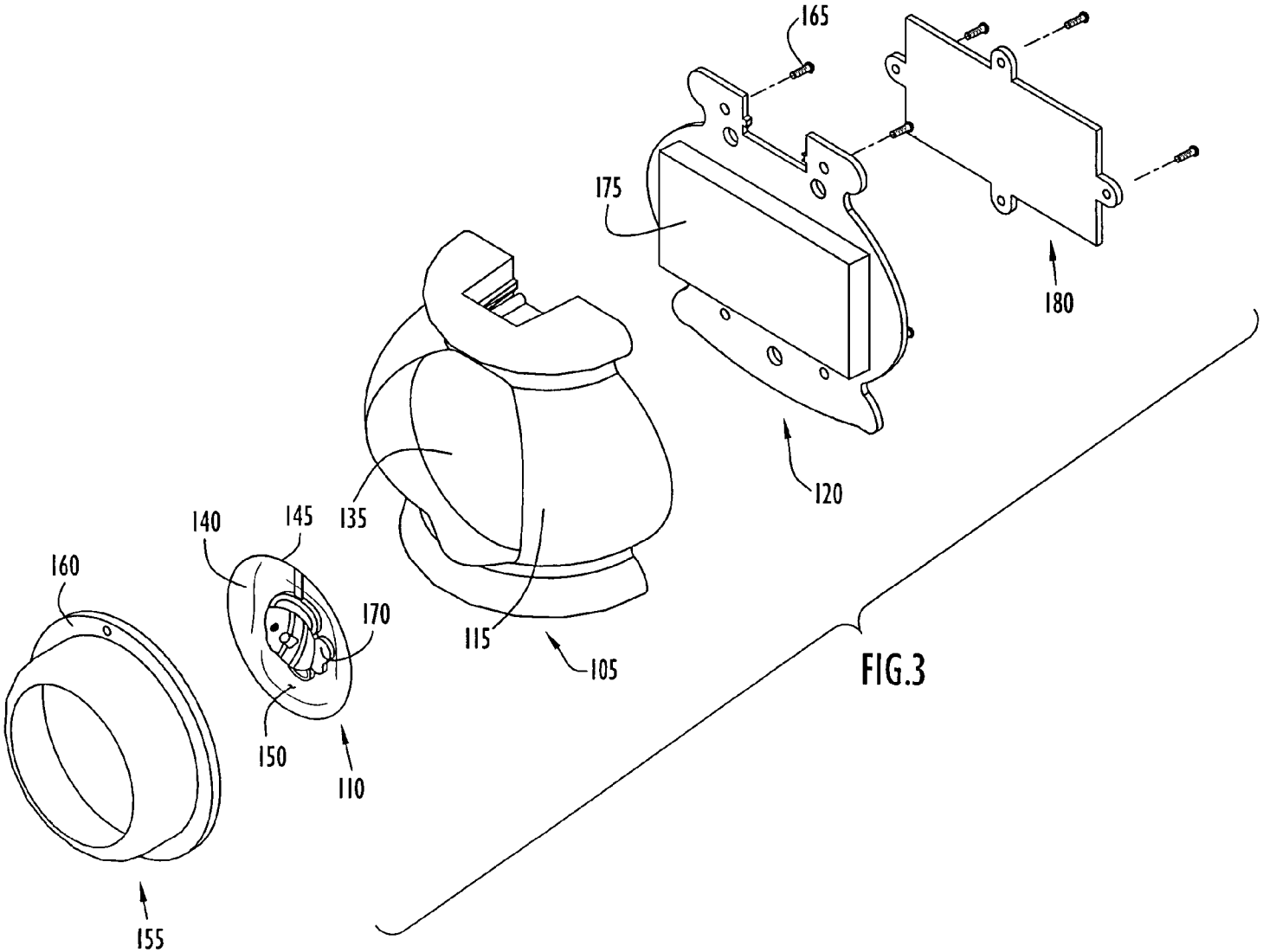
FIG. 3 illustrates an exploded perspective view of the interactive entertainment apparatus of FIG. 1.

The front wall 115 may be configured to display the fluid-filled container 110. FIG. 3 is an exploded perspective view of the interactive entertainment apparatus 10 of FIGS. 1 and 2. In the embodiment of FIG. 3, the front wall 115 of the shell 105 includes a recessed portion 135 configured to receive the fluid-filled container 110. The fluid-filled container 110 may attach to the front wall 115 of the shell 105 using conventional means including, but not limited to, adhesives. In the embodiment of FIGS. 1-3, the fluid-filled container 110 may be secured to the recessed portion 135 of the shell 105 by a front cover or frame 155. The frame 155 may be adapted to capture the fluid-filled container 110 against the shell recessed portion 135, as well as to expose at least a portion of the fluid-filled container 110 to a user of the interactive entertainment apparatus 10. As shown best in FIG. 3, the frame 155 may comprise a generally annular ring having a lip 160 extending about the periphery of the ring. Internal shell screws 165 may be used to secure the lip 160 (and thus the frame 155) to the front wall 115 of the shell 105. With this configuration, the fluid-filled container 110 may be exposed to a user such that the user may interact with the fluid-filled container 110 by, e.g., viewing the fluid within the container or contacting the exterior surface of the fluid-filled container 110.

The material comprising the fluid-filled container 110 is not limited, and may include rigid or flexible material. By way of example, the fluid-filled container 110 may comprise a pliable or pliant material. Specifically, as shown in the embodiment of FIG. 3, the fluid-filled container 110 may comprise a pliable front film 140 and a pliable rear film 145 connected about their peripheries so as to form a pouch. The connection forms a fluid-tight seal that maintains its integrity when compressed. For example, the films 140, 145 may be connected using waterproof adhesives, heat sealing, etc. The fluid-filled container 110 may be transparent, translucent, or opaque. For example, the material comprising the fluid-filled container 110 may include flexible polymer materials such as polyester, polyethylene, polyvinyl chloride, rubberized materials, etc.

As discussed above, the fluid-filled container 110 may be at least partially filled with fluid 150. The fluid 150 may comprise, but is not limited to, gels, transparent fluid (e.g., water, propylene glycol, glycerin, and/or mixtures thereof), translucent fluid, and opaque fluid. The fluid 150, moreover, may be colored using conventional pigments and dyes. When the material comprising the fluid-filled container 110 comprises a pliant material, an infant may interact with the fluid-filled container 110 by contacting the pliable front film 140 of the fluid-filled container 110 and displacing the fluid 150 contained therein. This interaction is illustrated in FIG. 4.

The fluid-filled container 110 may further include at least one decorative element 170 suspended in the fluid 150. The decorative element 170 may be tethered to the interior surface of the fluid-filled container 110, or may float freely within the fluid-filled container 110. The decorative element 170 is not limited, and may include figures (e.g., animals such as fish) and/or particles (e.g., glitter, holographic particles, foam pieces, confetti, etc).

Referring again to FIG. 3, the rear wall 120 of the shell 105 may further include a compartment 175 and a cover 180 adapted to extend over the compartment 175. The compartment 175 may be adapted to house a power source such as a battery or multiple batteries. The cover 180 may be secured to the rear wall 120 of the shell 105 using conventional fasteners such as screws. Once attached, the cover 180 is flush with the surface of the rear wall 120 of the shell 105 to define a generally flat surface.

Figure 4:
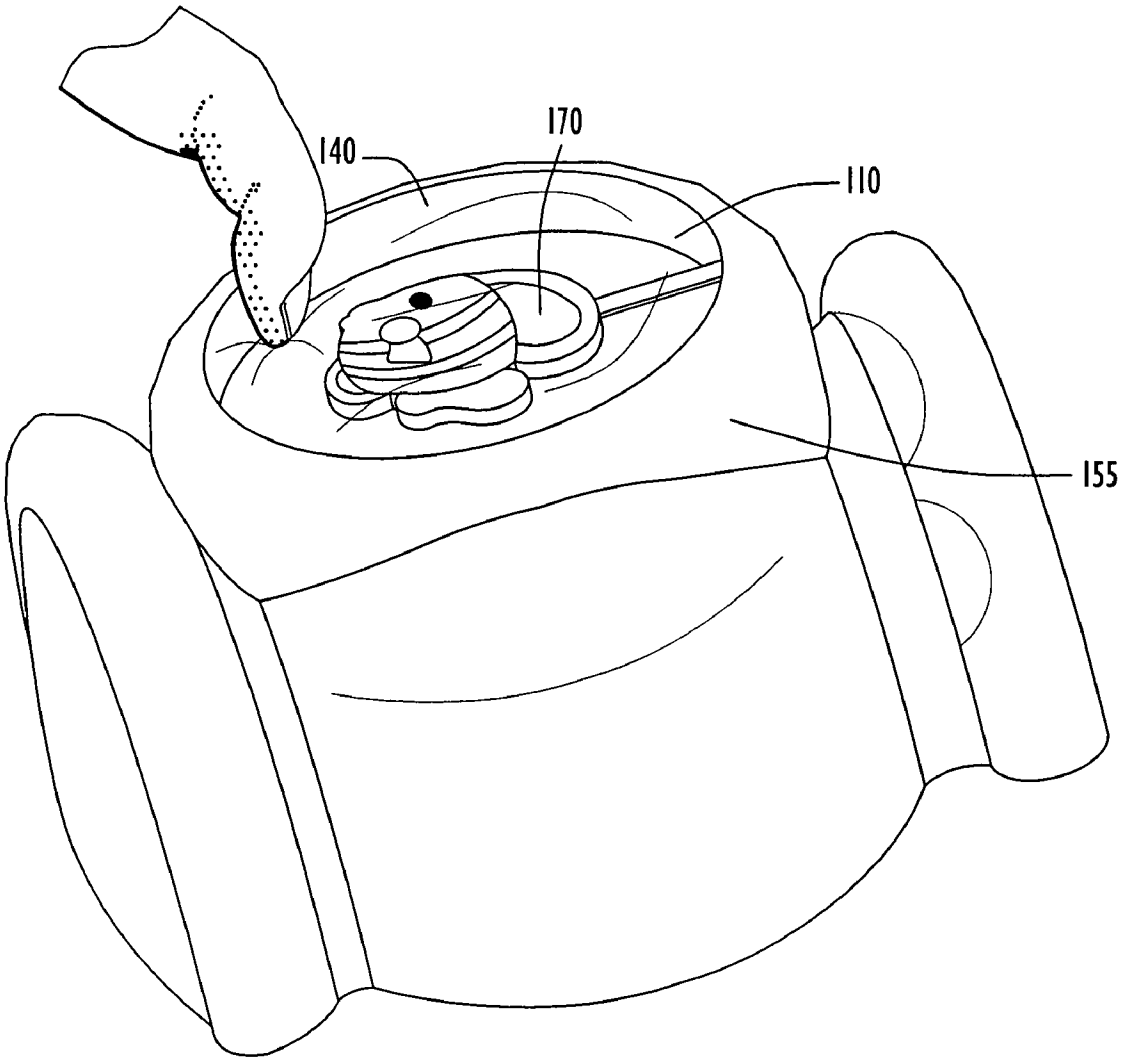
FIG. 4 illustrates a side perspective view of the interactive entertainment apparatus of FIG. 1, showing the compression of the pliable portion and the displacement of the fluid housed therein.

FIG. 4 illustrates a side perspective view of the interactive entertainment apparatus 10 of FIG. 1. As illustrated in FIG. 4, when a user presses his or her finger against the pliable front film 140 of the fluid-filled container 110, the fluid 150 contained therein is displaced as are any decorative elements 170 also housed therein.

Figure 5:
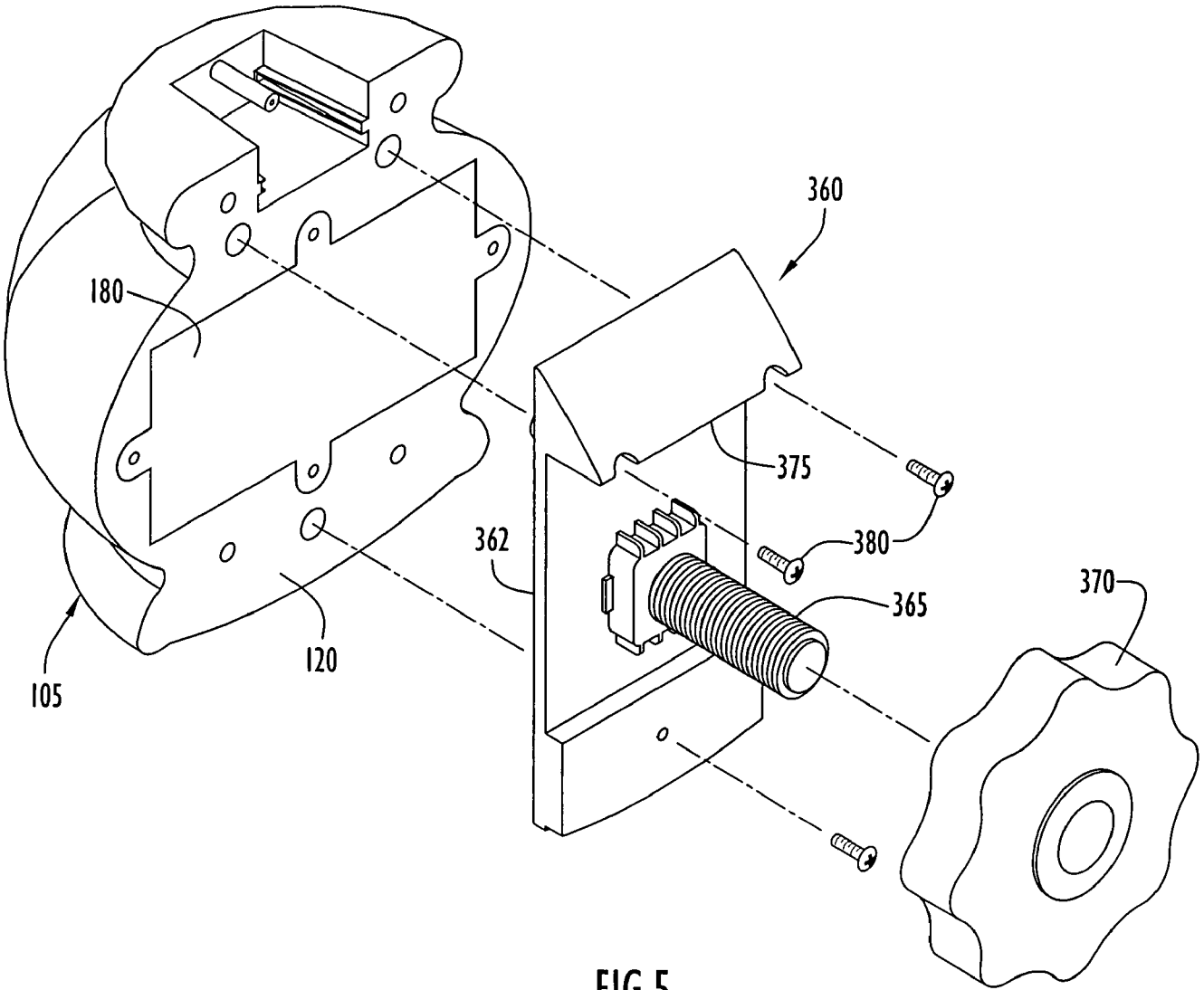
FIG. 5 illustrates a back perspective view of the interactive entertainment apparatus of FIG. 1, showing attachment of the mounting element according to an embodiment of the invention.

The interactive entertainment apparatus 10 may be adapted to connect to a child receiving device. Specifically, the interactive entertainment apparatus 10 may include an attachment or securing mechanism coupled to the rear wall 120 of the shell 105. The securing mechanism may comprise, but is not limited to straps, clamps, screws, or similar devices suitable for securing the activity device to a child-receiving device such as a crib. FIG. 5 illustrates a rear perspective view of the interactive entertainment apparatus 10, showing a securing mechanism according to an embodiment of the invention. As shown, the securing mechanism may comprise a bracket or mounting element 360 attached to the rear wall 120 of the shell 105. The mounting element 360 may include a plate having an engagement member or post 365 extending therefrom. The mounting element 360 may be secured to the rear wall 120 of the shell 105 via removable screws 380 configured to mate with threaded receptacles in the rear wall 120. Alternatively, the rear wall 120 of the shell 105 may include slots (not shown) configured to mate with clips (not shown) positioned along the plate 362 of the mounting element 360. With this configuration, the mounting element 360 can be removably attached to the rear wall 120 of the shell 105 of the interactive entertainment apparatus 10.

The engagement post 365 of the mounting element 360 may be externally threaded to couple with an internally threaded gripping member 370 (also called a mounting nut). A ledge 375 positioned along the upper edge of the mounting element 360 (i.e., on the upper portion of the plate 362) may be configured to engage a support on a child receiving device. By way of specific example, the interactive entertainment apparatus 10 can be mounted onto a crib rail, with the mounting element 360 (and in particular, the ledge 375) abutting the top rail of the crib (best seen in FIG. 7A). The securing mechanism couples the entertainment apparatus 10 to the child receiving device proximate a user (e.g., a child) received within the child receiving device such that the child can interact with the entertainment apparatus 10 (e.g., can contact the pliable front film 140 of the fluid-filled container 110).

Figure 6:
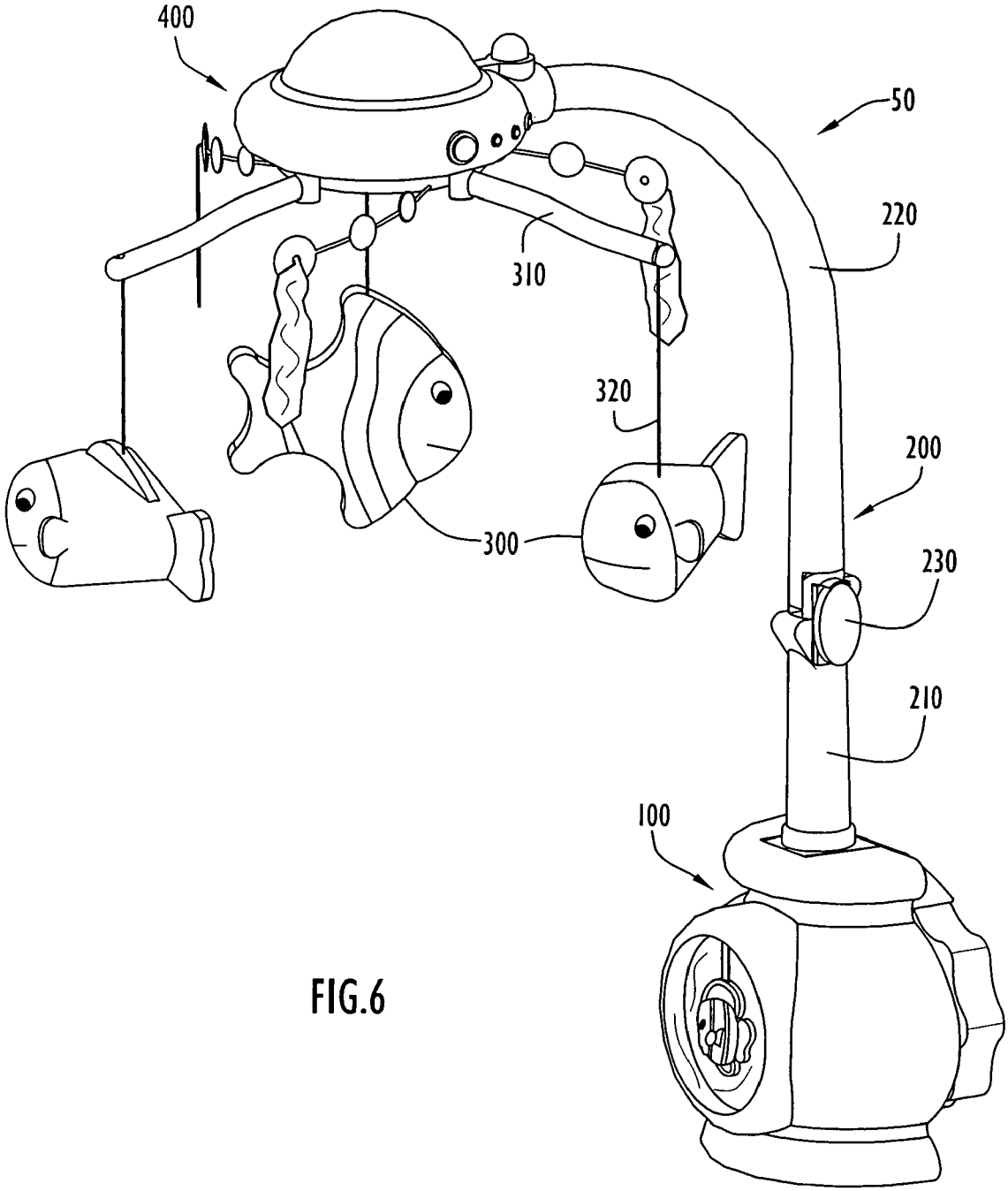
FIG. 6 illustrates a perspective view of an interactive entertainment apparatus according to an additional embodiment of the present invention.

FIG. 6 illustrates a perspective view of an additional embodiment of the interactive entertainment apparatus in accordance with the present invention. As shown in the embodiment of FIG. 6, the interactive entertainment apparatus 50 may include an infant mobile structure. With the exception of the fluid-filled container 110, the apparatus 50 may generally include the structure described in U.S. Published Patent Application No. 2003/0064818 (Drosendahl et al.), incorporated herein by reference in its entirety. The device is, however, is not limited to the structure disclosed therein.

Referring to FIG. 6, the interactive entertainment apparatus 50 may include a base 100, a support arm 200, and at least one entertainment element 300. The base 100 may include the same basic structure as the interactive entertainment apparatus 10 described above (FIGS. 1-5). The base 100 may, however, may be adapted to secure and suspend the support arm 200 (as well as the entertainment element 300) above a surface. By way of example, the top of the shell 105 may include a slot or receptacle (not shown) configured to frictionally receive and secure the lower portion 210 of the support arm 200.

The support arm 200 may include a structure adapted to suspend an entertainment element 300 above the base 100. As shown in the embodiment of FIG. 6, the support arm 200 may comprise a post extending upward from the top of the base 100. As mentioned above, the post may connect to the base 100 via a protrusion that engages a slot within the base 100. The slot in the base 100 and the support arm 200 may further include an electrical connection (e.g., conductive contacts) operable to transfer power from a power source (e.g., a battery) stored in the base 100 to electronic devices located in the support arm 200 and/or the housing 400 (discussed below).

The interactive entertainment apparatus 50, moreover, may be operable to convert from a first, child-receiving-device orientation, to a second, surface (tabletop) placement orientation. By way of example, the support arm 200 may be adapted to pivot. As shown in the embodiment of FIG. 6, the support arm 200 may include a first or lower portion 210 and a second or upper portion 220. The first portion 210 may be coupled to the second portion 220 via a reorientation mechanism 230. The reorientation mechanism 230 may permit one arm portion 210, 220 to be rotated with respect to the other arm portion 210, 220, as well as selectively lock the portions 210, 220 at a desired angle. The structure of the reorientation mechanism 230 may include, but is not limited to, a pivotal connection including a release knob that, when engaged (by pulling the knob radially away from the support arm 200), permits the rotation (e.g. a rotation of 90°) of the second portion 220 with respect to the first portion 210. This type of mechanism is described fully in U.S. Published Patent Application No. 2003/0064818, referenced above. Alternatively, the reorientation mechanism 230 may comprise a spring-loaded clutch configured to pivot by application of force to the arm portions 210, 220, negating the need for a release knob. Thus, it is possible to change the orientation of the interactive entertainment apparatus 50 by repositioning the base 100 with respect to the support arm 200 and/or by repositioning the support arm 200 with respect to the base 100.

Figure 7A:
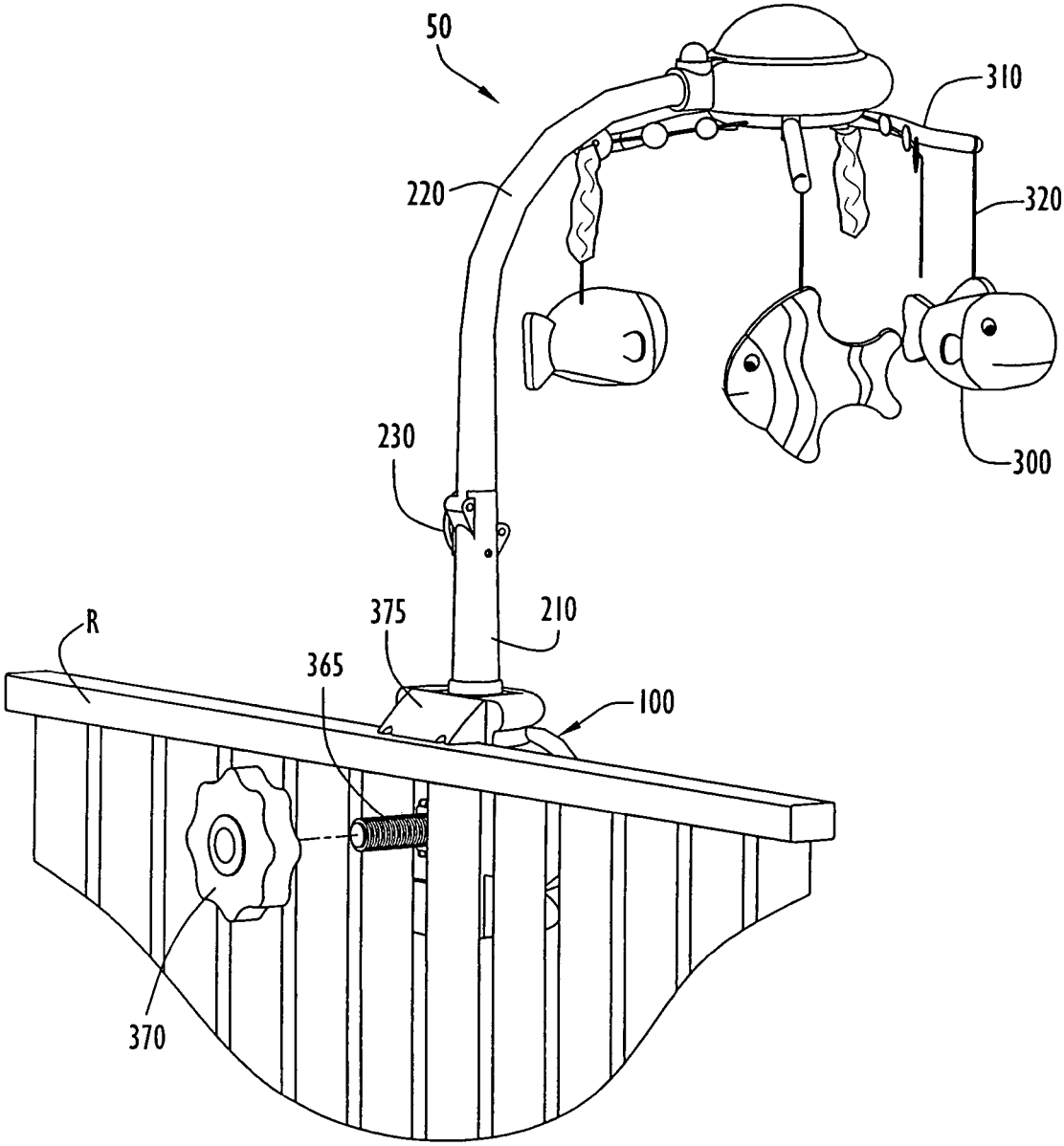
FIGS. 7A and 7B illustrate perspective views of the upright (crib-mounted) and folded (tabletop) configurations, respectively, of the entertainment apparatus of FIG. 6.
Figure 7B:
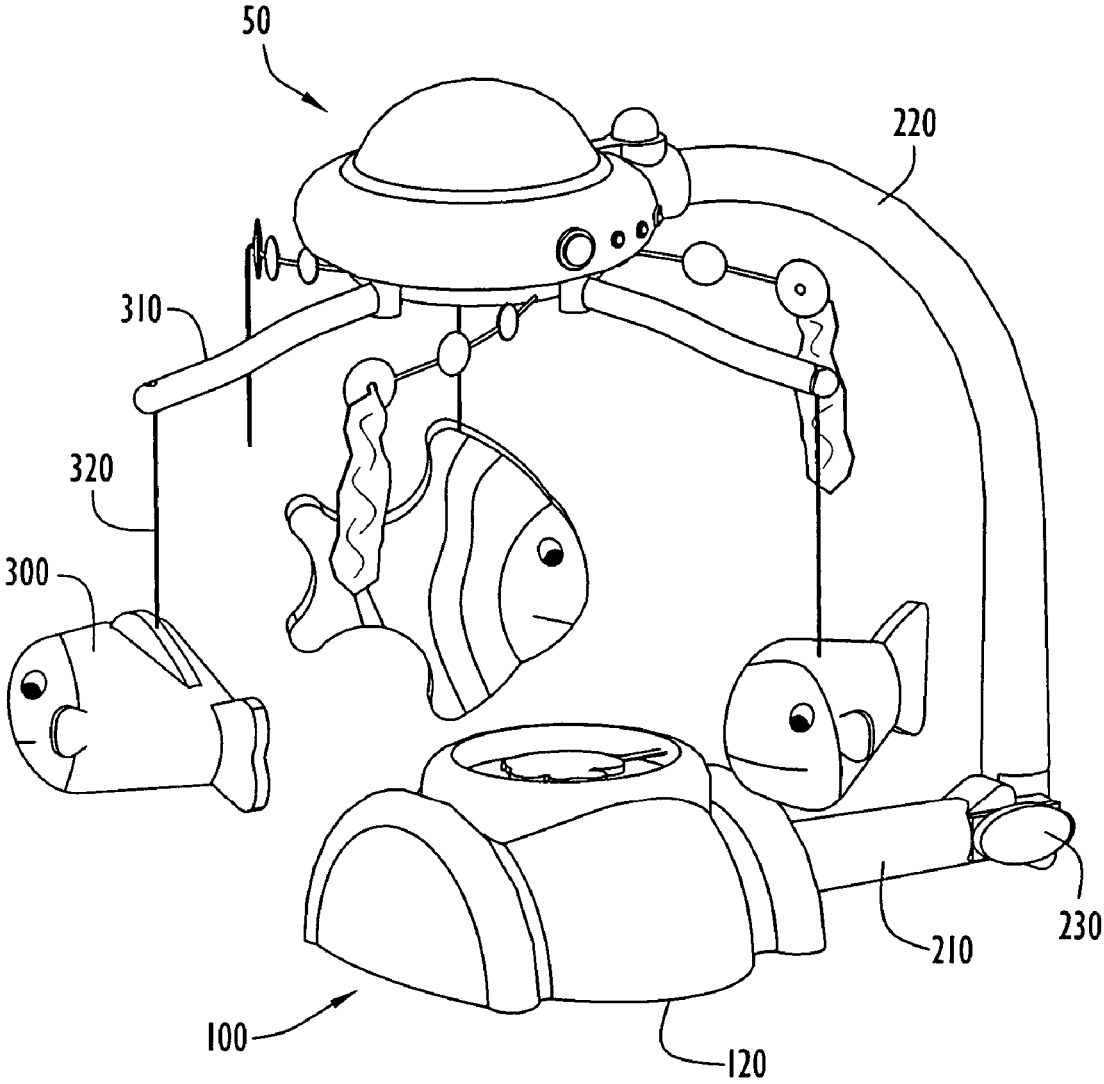

FIGS. 7A and 7B illustrate the configurations of the interactive entertainment apparatus 50 according to an embodiment of the invention. As shown, the support arm 200 may be positioned in either an upright (crib-mounted) configuration or a folded (tabletop) configuration. In the upright configuration, the lower portion 210 of the support arm 200 may be aligned with the upper portion 220 of the support arm 200 (as shown in FIG. 7A). In contrast, when the apparatus 50 is positioned in its folded configuration, the lower portion 210 (and thus the base 100) may be oriented perpendicularly with respect to the upper portion 220 (as shown in FIG. 7B).

In the upright configuration, the interactive entertainment apparatus 50 is suitable to mount on a child receiving device such as a crib. As best seen in FIG. 7A, the apparatus 50 can be mounted by positioning the ledge 375 against the top rail R of the crib, and tightening the nut 370 onto the engagement post 365 to capture the base 100 onto the crib rail R. To convert the interactive entertainment apparatus 50 to the folded configuration, the mounting element 360 is removed from the base 100 (e.g., by removing the screws securing the mounting element 360 to the base 100). The reorientation mechanism 230 may then be engaged to rotate the second portion 220 of the support arm such that it is oriented perpendicularly with respect to the first portion 210. The base of the apparatus may then be set onto a supporting surface (e.g., a table), with the rear wall 120 of the base 100 contacting the supporting surface (as illustrated in FIG. 7B).

The entertainment element 300 includes one or more objects capable of drawing the interest of an infant. Referring back to FIG. 6, the entertainment elements 300 may include, but are not limited to plush figures, rigid figures, teethable shapes, etc. The entertainment elements 300, moreover, may include animated features, may be stationary (non-moving) or may be non-stationary (moving) (as discussed in greater detail below). The entertainment elements 300 may connect directly to the support arm 200 (e.g., the top edge of the support arm upper portion 220), or may connect indirectly to the support arm through a housing 400 (discussed below). The entertainment elements 300 may be detachable to enable direct interaction with the elements 300 by the user (remote from the device 100).

The interactive entertainment apparatus 50 may further include a housing or hub 400. The housing 400 may include a structure configured to contain electronic elements, as well as to support one or more of the entertainment elements 300. The structure of or the materials comprising the housing 400 is not limited. As shown in the embodiment illustrated in FIG. 8, the housing 400 may include an upper section or dome 410 and a lower section or dome 420 connected to a centrally disposed ring 430. The upper and lower domes 410, 420 may include portions that are transparent, translucent, and/or opaque. Preferably, the upper dome 410 and the lower dome 420 are transparent.

The housing 400 may further contain sensory generating devices such as speakers, light sources, motors, etc. For example, the housing 400 may contain a speaker (shown schematically in FIG. 9); furthermore, the housing 400 may include a perforated speaker grill aligned with the speaker to optimize sound emission to a user (not shown). The housing 400, moreover, may include one or more light sources (not shown) adapted to project light through the lower dome 410, the upper dome 420, or both. The light source may comprise, but is not limited to, light emitting diodes (LEDs) and/or grain of wheat bulbs (GOWs). By way of specific example, one light source may project through the upper dome 410, and another light source may project through the lower dome 420, providing two independent sources of illumination.

In addition, one or both of the domes 410, 420 may be operable to project an image onto remote surface. Specifically, the domes 410, 420 may include indicia or a pattern (not shown) configured such that when light is projected through the dome 410, 420, images corresponding to the indicia or pattern are projected onto a surface spaced from the apparatus 50. By way of example, the indicia or pattern may comprise a stenciled film (not shown) extending along the interior surface of a transparent dome 410, 420 that selectively permits light (generated by a light source within the housing 400) to pass through the stencil, transmitting an image onto a remote surface (e.g., a wall, a tabletop, or ceiling).

The housing 400 may further include one or more actuators operably coupled to a control unit and configured to control sensory stimulating output. In the embodiment illustrated in FIG. 8, the central ring 430 may include four actuators 450, 455, 460, 465. Each actuator 450, 455, 460, 465 may be coupled to a switch capable of sending a signal to a control unit (not shown in FIG. 8, but discussed in greater detail below). By way of example, engaging actuator 450 (power button) may engage a switch that activates/deactivates a power source, while engaging actuator 455 (light switch) may engage a switch operable to control the illumination pattern of the housing 400. Furthermore, actuator 460 (music mode switch) may engage a switch configured to control the musical output of the speaker, and actuator 465 (volume control switch) may engage a switch configured to control the volume of the audio output via the speaker. The type of actuator is not limited to that shown herein, and may include depressible actuators, sliding actuators, etc.

The housing 400 may further include an optical receiver 470 operable to activate electronic features of the device. By way of example, the housing ring 430 may include an optical receiver 470 such as an infrared receiver coupled to the control unit. When a light beam having the appropriate frequency is exposed to the receiver 470, the output of the interactive entertainment apparatus 50 may be activated, deactivated, or altered. The source of the light beam is not limited, and may include a handheld emitter (e.g., a remote control device (discussed in greater detail below)). The receiver 470 may include, but is not limited to, an infrared receiver (such as PIC-1018SMB module, available from Waitrony Co., Ltd., China (www.waitrony.com)).

A portion of the housing 400 may further be configured for selective rotation with respect to the support arm 200. By way of example, the upper dome 410 and/or the lower dome 420 may individually or collectively move about the central ring 430 such that the domes 410, 420 rotate horizontally with respect the ring 430. The domes 410, 420 may include a gear connected to one or more drive trains (none shown). The housing 400, moreover, may contain one or more motors (not shown) configured to engage the drive trains and move the domes 410, 420 along their respective rotational pathways.

As shown in FIG. 6, one or more connectors 310 may attach to the housing 400. The connectors may support one or more entertainment elements 300 such that the elements 300 are suspended above the base 100. The connectors 310 may include, but are not limited to, a flexible connector and/or a rigid connector. The flexible connector may comprise, e.g., a fabric string or an elastic cord. The rigid connector may comprise, e.g., resilient spoke extending radially from the housing 400. The connectors 310 may be permanently attached to the housing 400, or may be detachable. For example, the connectors 310 may connect to the housing 400 through fasteners such as screws. Alternatively, when rigid connectors are used, the connectors 310 may include a tab (not shown) that engages a slot (not shown) positioned proximate the lower dome 420. The tab mates with the slot, providing a secure, yet releasable, connection.

As discussed above, the entertainment elements 300 may include non-stationary elements. By way of example, as shown in FIGS. 7A and 7B, an entertainment element 300 may be suspended from the housing 400 by means of a rigid connector 310 and a secondary flexible connector 320 (e.g., a fabric string); consequently, as the lower dome 420 rotates, motion is imparted to the entertainment elements 300 (i.e., the elements 300 not only rotate via rigid connectors 310, but sway back and forth via flexible connectors 320).

Figure 8:
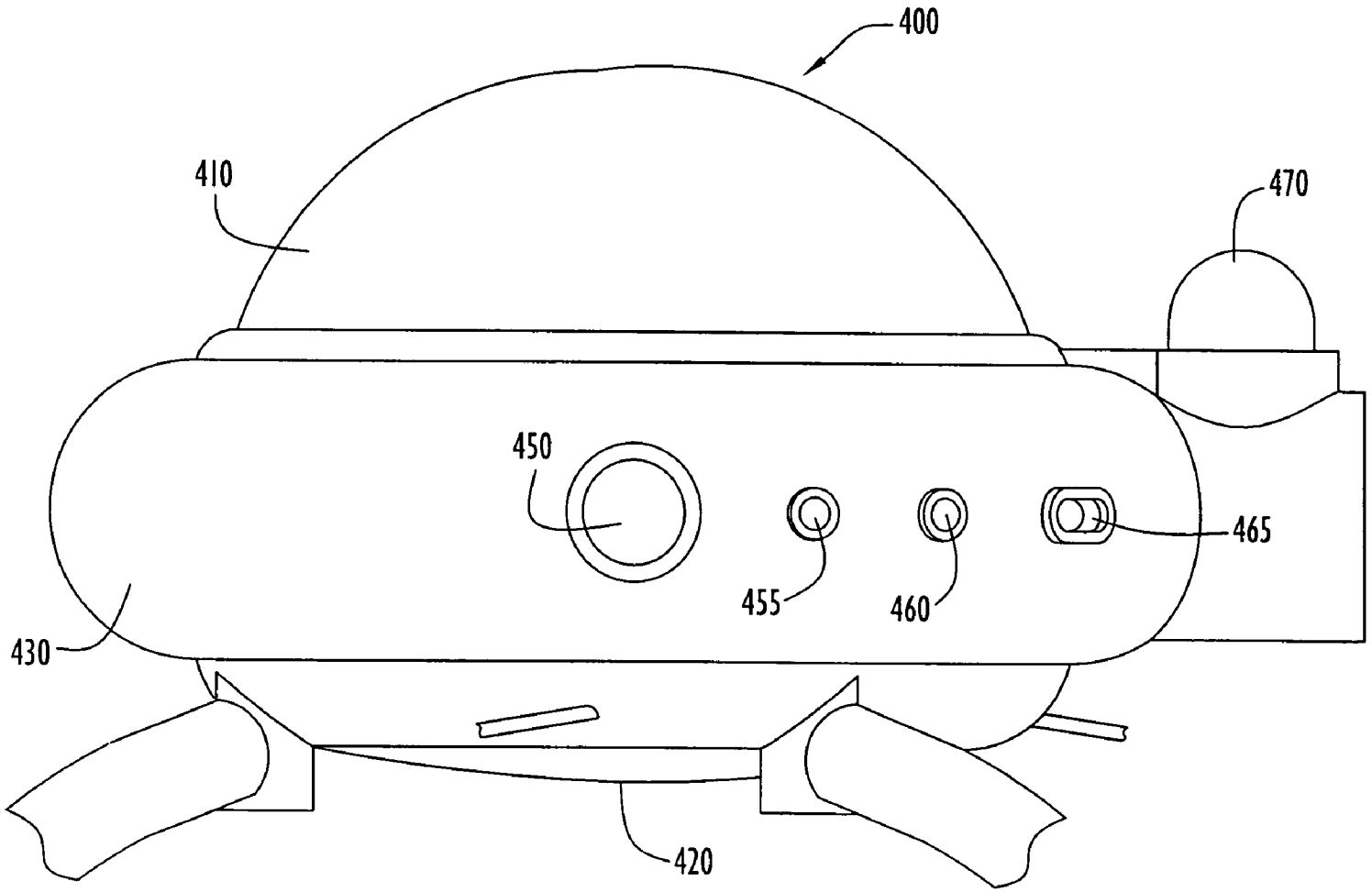
FIG. 8 illustrates a perspective close-up view of the housing of the interactive entertainment apparatus of FIG. 6.
Figure 9:
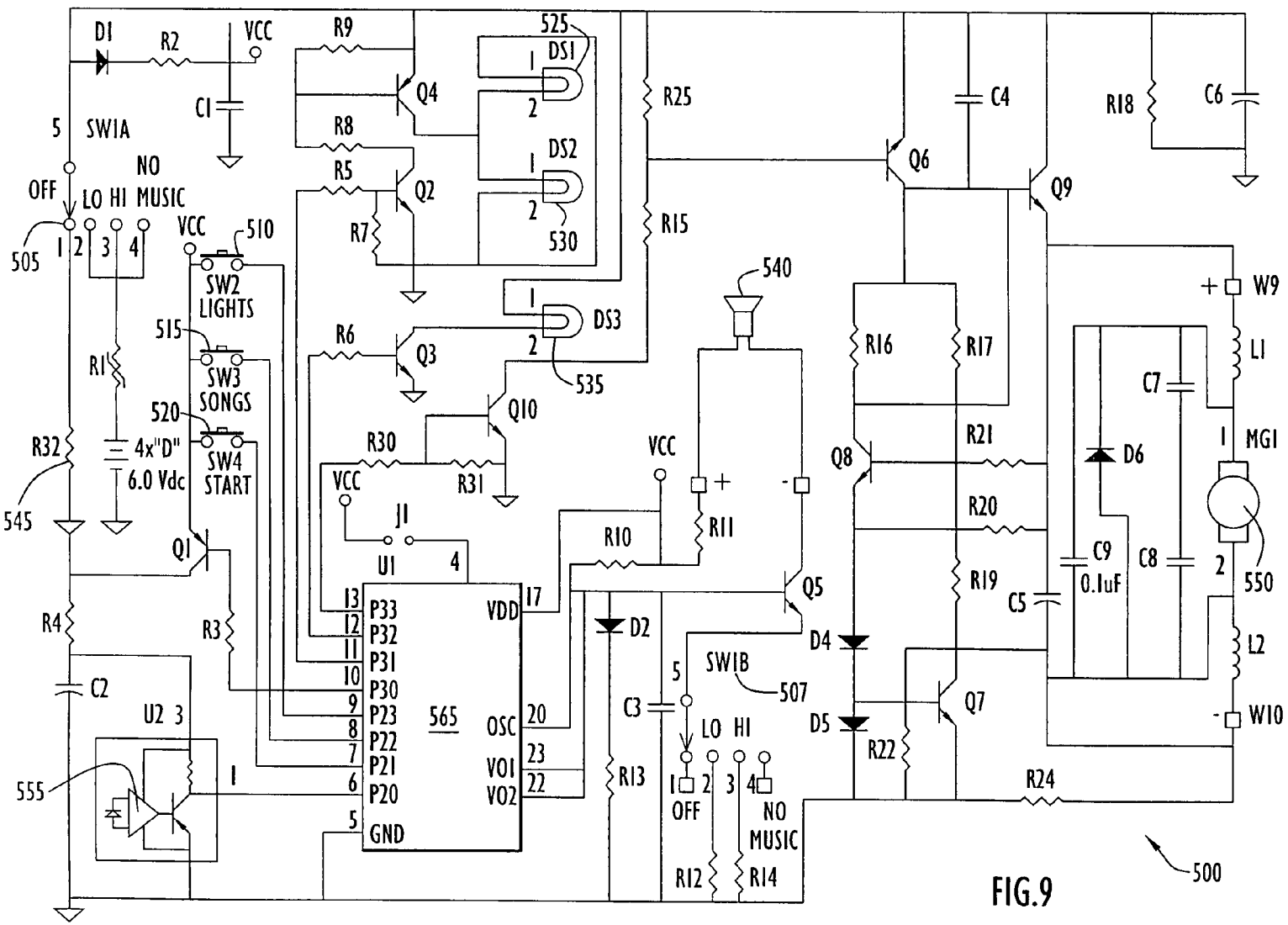
FIG. 9 illustrates a schematic diagram of the electronics assembly of the interactive entertainment apparatus according to an embodiment of the present invention.

FIG. 9 illustrates a schematic diagram of the electronics assembly 500 associated with the interactive entertainment apparatus 50 in accordance with the present invention. As discussed above, the electronics assembly 500 may include one or more sensory output generating devices (e.g., light sources, motors, and speakers) engaged and disengaged by one of more switches as controlled by a control unit. In the embodiment of FIG. 8, the electronics assembly 500 includes four switches 505 (illustrated schematically as 505 (SW1A) and 507 (SW1B)), 510 (SW2), 515 (SW3), and 520 (SW4); three grain of wheat bulbs (GOWs) 525 (DS1), 530 (DS2), and 535 (DS3); a speaker 540 (e.g., 2.2 in, 16 ohm, 250 mW speaker); a power source 545; a motor 550; an optical receiver 555 (e.g., a infrared receiver available under the trade name PIC-1018SMB from Waitrony Co., Ltd., China (www.waitrony.com)); and control unit 565. The type of power source 545 is not limited, and may include direct and/or alternating current sources. By way of specific example, four "D" batteries may be used. The control unit 565 may be operably coupled to each of the lights 525, 530, 535; the speaker 540; the power source 545; the motor 550; the optical receiver 555; and the switches 505, 507, 510, 515, 520. The control unit 565 may comprise, but is not limited to, microcontrollers, microprocessors, and integrated circuits. By way of specific example, the control unit 565 may comprise a four-channel single chip speech controller, available from SONiX Corporation (Chupei City, Taiwan (www.sonix.com.tw) and sold under the tradename SN66020). The control unit 565 may be configured to not only recognize signals generated by the various switches 505, 507, 510, 515, 520; but also to generate and control the operational output of the interactive entertainment apparatus 50 (i.e., of the sensory output generating devices, including motor activation). For example, the control unit 565 may activate the lights 525, 530, 535; the speaker 540, and the motor 550, generating electronic sensory stimulating output such as audio and visual output (e.g., sound effects, verbal messages, music, motion, and light patterns).

Each switch 505, 507, 510, 515, 520 may be associated with a particular feature of the interactive entertainment apparatus 50. For example, a first switch 505, 507 may include a multi-position switch associated with the sliding actuator 465 located along the ring 430 of the housing 400. When actuated, the first switch 505, 507 may communicate with the control unit 565, and switch-specific output may be generated (e.g., the actuator 465 and associated switch 505, 507 may provide or terminate power to the interactive entertainment apparatus 50, may control the sound level generated by the speaker 540, and may provide or terminate power to the motor 550). Similarly, the second switch 510 (associated with actuator 455) may alter the output of the interactive entertainment apparatus 50 by, for example, altering the light projection such that the upper dome 410 is illuminated, the lower dome 420 is illuminated, both domes 410, 420 are illuminated, or neither dome 410, 420 is illuminated. The third switch 515 (associated with actuator 460) may alter the musical output of the device, for example, by changing the song style. Finally, the fourth switch 520 (associated with actuator 450) may start or stop the sensory generating devices (e.g., music and lights). With this configuration, a user may control the output of the interactive entertainment apparatus 50.

Figure 10:
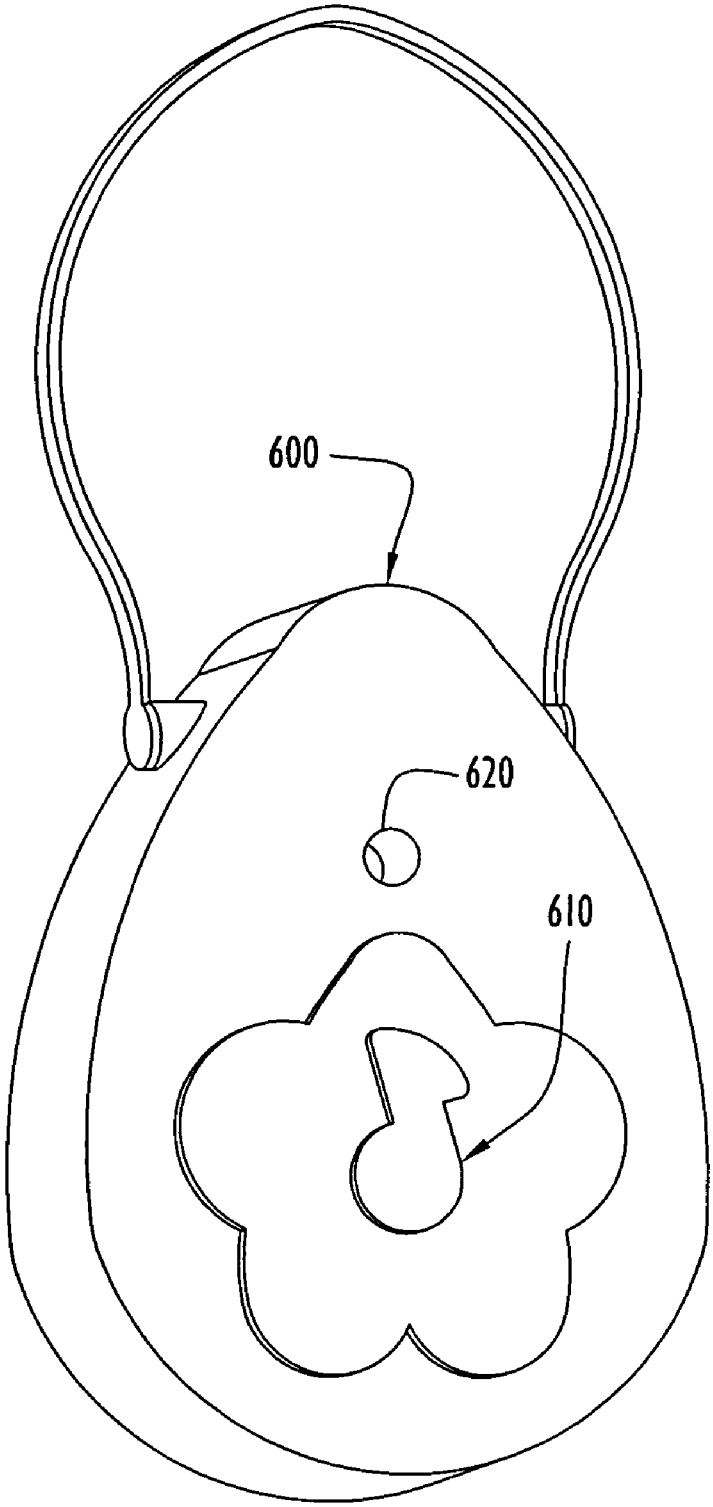
FIG. 10 illustrates a perspective view of a remote control unit in accordance with an embodiment of the invention.

FIG. 10 illustrates a remote control device capable of use with the interactive entertainment apparatus 50 according to an embodiment of the present invention. As shown, the remote control 600 may comprise a handheld unit having an actuator button 610 and an indicator light 620 (displayed whenever the actuator button 610 is engaged). The remote control 600 may further include an optical emitter (not shown) configured to send a signal to the optical receiver 470 of the interactive entertainment apparatus 50 (discussed above and seen in FIG. 8). The remote control 600 may include a window (not shown) to permit the signal to travel from the emitter.

Figure 11:
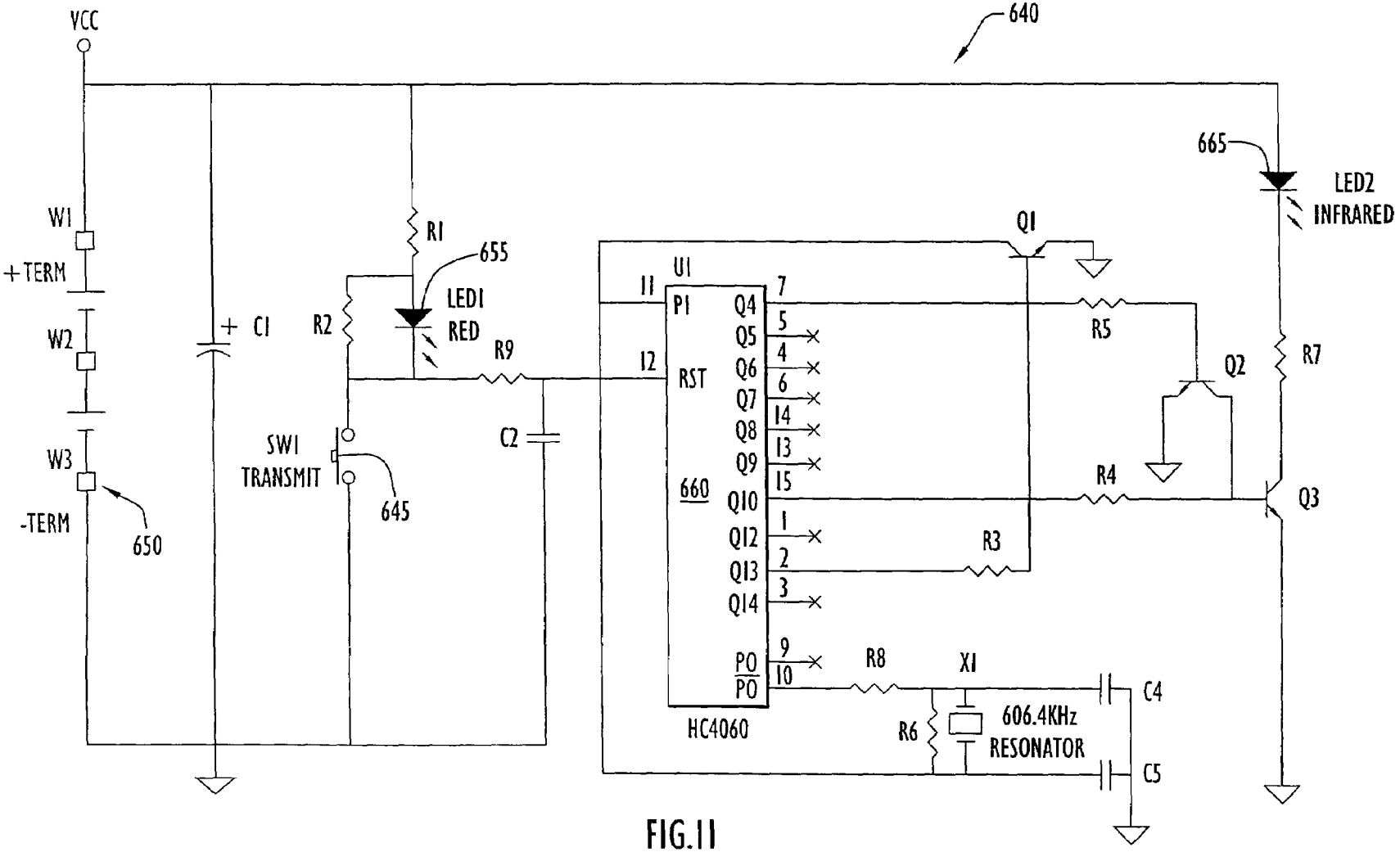
FIG. 11 illustrates a schematic diagram of the electronics assembly of the remote control unit of FIG. 10 according to an embodiment of the present invention Like reference numerals have been used to identify like elements throughout this disclosure.

FIG. 11 is a schematic diagram of an electronics assembly for the remote control 600 according to an embodiment of the invention. As shown, the electronics assembly 640 includes a switch 645 (SW1), a power source 650, a light source 655, and an optical emitter 665. Each of the power source 650, the light source 655, and the optical emitter 665 may be operably coupled to a control unit 660. The switch 645, corresponding to the actuator 610 on the remote control 600, may comprise, but is not limited to, mechanical, optical, magnetic, and electrical switches. By way of specific example, the switch 645 may comprise a silicone rubber switch. The power source 650 may comprise, but is not limited to, alternating and/or direct current sources. By way of specific example, two "AA" batteries may be used. The light source 655 may correspond to the indicator light 620 of the remote control 600 (shown in FIG. 10). The light source 655 may comprise, but is not limited to, light emitting diodes (LEDs) and/or grain of wheat (GOW) bulbs. By way of specific example, the light source 655 may comprise a 5 mm red GaP LED. The optical emitter 665 may comprise, but is not limited to, an infrared emitting diode such as a GaAlAs LED (available under the tradename IE-0530HP from Waitrony Co., Ltd, China (www.waitrony.com)). The control unit 660 may comprise, but is not limited to, microcontrollers, microprocessors, and integrated circuits.

In operation, when the actuator button 610 on the remote control 600 is depressed, the switch 645 is closed, sending a signal to the control unit 660. The control unit 660, in turn, sends a signal that activates not only the light source 655 (i.e., the indicator light 620) but also the infrared emitter 665. An infrared beam is generated, which travels from the remote control 600 and toward the receiver 470 located on the housing 400. The receiver 470 (illustrated schematically as 555 in FIG. 9) receives the infrared beam, and sends a signal to the control unit 565 of the housing electronics assembly 500. In response to the signal, the control unit 565 may then alter the output of the interactive entertainment apparatus 50 (e.g., by providing power, terminating power, or altering sensory output).

With the above configurations, an infant may interact with the above described apparatuses 10, 50 in several ways. In addition to visually focusing on the entertainment elements 300 or on the lighted images projected by the housing 400, the infant may further view the fluid through a transparent portion of the base 100 or shell 105. The infant, furthermore, may develop tactile skills by interacting with the pliable portion of the apparatuses 10, 50. By contacting the pliable front film 140 of the fluid-filled container 110, the fluid 150 contained therein is displaced as are any decorative elements 170 also housed therein.

While the invention has been described in detail and with reference to specific embodiments thereof, it will be apparent to one skilled in the art that various changes and modifications can be made therein without departing from the spirit and scope thereof. For example, it is to be understood that terms such as "top", "bottom", "front", "rear", "side", "height", "length", "width", "upper", "lower", "interior", "exterior", "inner", "outer" and the like as may be used herein, merely describe points of reference and do not limit the present invention to any particular orientation or configuration. In addition, the interactive entertainment apparatus 10, 50 can be of any size and shape. Either the shell 105 or the housing 400 may include any number of electronic components and/or any number of power sources. The type of child receiving device is not limited and, in addition to infant cribs, may include car seats, infant swings, infant gyms, etc. The electronics assemblies 500, 640 may include any combination of lights, speakers, animated member, motors, and sensory output generating devices. The control units 565, 660 may produce any combination of audio and visual effects including, but not limited to, animation, lights, and sound (music, speech and sound effects). The output pattern is not limited and includes any pattern of music, lights, and/or sound effects. The electronics assembly 500, 640 may also include additional switches to provide additional sensory output activation. Thus, it is intended that the present invention covers the modifications and variations of this invention that come within the scope of the appended claims and their equivalents.

I claim:

1. An entertainment apparatus comprising:

a base including an interactive transparent portion containing a fluid viewable through said interactive transparent portion, wherein said interactive transparent portion is substantially housed within said base;

a support arm having a first end and a second end, said base being located proximate said first end of said support arm and said support arm extending from said base;

a housing coupled to said second end of said support arm; and at least one entertainment element suspended from said housing, wherein said support arm is repositionable with respect to said base such that the entertainment apparatus operates in a first position, in which said base couples to a vertical surface, and a second position, in which said base is supported on a horizontal surface, and wherein the entertainment apparatus is configured to permit selective interaction with said interactive transparent portion in both said first position and said second position.

2. The entertainment apparatus of claim 1, wherein:

said housing includes an upper section and a lower section; and said housing further includes a light source that projects through at least one of said upper section and said lower section.

3. The entertainment apparatus of claim 1, wherein said housing comprises a mobile operable to rotate said at least one entertainment element.

4. The entertainment apparatus of claim 1, wherein said base further includes an attachment mechanism configured to attach said base to a child receiving device and to position said support arm over said child receiving device.

5. The entertainment apparatus of claim 4, wherein said child receiving device is a crib.

6. The entertainment apparatus of claim 1, wherein:

said interactive transparent portion comprises a compressible, pliable pouch; selectively applying an external pressure directly to said pouch displaces said fluid; and said fluid remains within said pouch during displacement.

7. The entertainment apparatus of claim 1, wherein said base further includes at least one decorative element.

8. The entertainment apparatus of claim 1, wherein said fluid is at least one of transparent, translucent, and colored.

9. The entertainment apparatus of claim 1, wherein said base is partially filled with said fluid.

10. The entertainment apparatus of claim 1, wherein said base includes a back wall, two side walls, and a front wall, and wherein said front wall includes said transparent portion.

11. An entertainment apparatus for use with a child receiving device comprising:

a base including:

a shell portion, and a pliable portion housed within the shell portion substantially such that the pliable portion is at least partially exposed for contact by a user, wherein the pliable portion comprises a pouch having fluid housed therein; and an attachment mechanism configured to secure said base to a child receiving device proximate a child received in said child receiving device such that said child can contact said pliable portion to displace said fluid within said pouch.

12. The entertainment apparatus of claim 11, wherein said fluid is at least one of transparent, translucent, and colored.

13. The entertainment apparatus of claim 11, wherein:

said pouch further includes at least one decorative element; and said exposed pliable portion permits selective contact with said pouch to displace said fluid and said decorative element therein.

14. The entertainment apparatus of claim 11 further comprising a support arm extending from said base and at least one entertainment element suspended from a distal end of said support arm for the entertainment of the child received within the child receiving device.

15. The entertainment apparatus of claim 11, wherein said child receiving device is a crib.

16. The entertainment apparatus of claim 14 further including a housing coupled to the distal end of said support arm, wherein said at least one entertainment element is coupled to said housing.

17. The entertainment apparatus of claim 16, wherein at least a portion of said housing rotates with respect to said support arm.

18. The entertainment apparatus of claim 16, wherein:

said shell portion houses a power source separate from said pliable portion;

said housing is configured to generate electronic sensory output; and said base is electrically connected to the housing via said support arm.

19. The entertainment apparatus of claim 1, wherein:

said housing is configured to generate electronic sensory output; and said base is electrically connected to said housing via said support arm.

20. The entertainment apparatus of claim 5, wherein said base includes a power source;

said mobile includes an electronic device; and said support arm includes an electrical connection operable to transmit power from said power source to said electronic device in said mobile.

21. An entertainment apparatus comprising:

a base operable to couple to a child receiving device;

a pliable pouch coupled to the base such that the pliable pouch is substantially housed within said base, said pliable pouch having fluid and a decorative element housed therein;

a support arm extending from said base; and at least one entertainment element suspended from said support arm, wherein selectively applying an external pressure directly to said pliable pouch displaces said fluid and said decorative element, and wherein said fluid remains within said pliable pouch during displacement.

22. The entertainment device according to claim 21, wherein:

said base comprises a shell; and said pliable pouch is housed within said shell such that it is at least partially exposed to permit the selective application of direct pressure.

23. The entertainment apparatus of claim 22, wherein:

said support arm is repositionable with respect to said base from a first position to a second position; and said decorative element may be displaced in both said first and second positions of said support arm.

24. The entertainment apparatus of claim 23, wherein:

in said first position, said base is oriented vertically with respect to said child receiving device; and in said second position, the base is oriented horizontally with respect to said child receiving device.

25. The entertainment apparatus according to claim 21, wherein said fluid contained within said pliable pouch is non-aqueous.

26. The entertainment apparatus according claim 21, wherein:

the entertainment apparatus further includes a mobile coupled to said support arm;

said entertainment element being suspended from said mobile;

said mobile is adapted to generate electronic sensory output; and said base is electrically connected to said mobile via said support arm.

27. The entertainment apparatus according claim 26, wherein:

said base includes a power source;

said mobile includes an electronic device; and said support arm includes an electrical connection operable to transmit power from said power source to said electronic device in said mobile.

28. The entertainment apparatus according to claim 21, wherein said decorative element is tethered to an interior surface of said pliable pouch.

* * * * *

UNITED STATES PATENT AND TRADEMARK OFFICE

CERTIFICATE OF CORRECTION

PATENT NO. : 7,476,142 B2
APPLICATION NO. : 11/069036
DATED : January 13, 2009
INVENTOR(S) : Mary G. Mastrosimone-Gese It is certified that error appears in the above-identified patent and that said Letters Patent is hereby corrected as shown below:

On the Title Page, Item (56) References Cited, p. 2, OTHER PUBLICATIONS:

"Fisher-Price Salary Night Mobile Product Guide" should read "Fisher-Price Starry Night Mobile Product Guide"

Col. 11, line 6: "claim 5," should read "claim 3,"

Signed and Sealed this

Twenty-sixth Day of May, 2009

JOHN DOLL
*Acting Director of the United States Patent and Trademark Office*